US006440654B1

(12) United States Patent
Anderson et al.

(10) Patent No.: US 6,440,654 B1
(45) Date of Patent: Aug. 27, 2002

(54) PHOTOGRAPHIC ELEMENT CONTAINING AN ELECTRICALLY-CONDUCTIVE LAYER

(75) Inventors: Charles C. Anderson, Penfield; Mario D. DeLaura, Hamlin; Debasis Majumdar, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/825,325

(22) Filed: Apr. 3, 2001

(51) Int. Cl.[7] ..... G03C 1/89
(52) U.S. Cl. ..... 430/529; 430/527; 430/531
(58) Field of Search ..... 430/527, 529, 430/531

(56) References Cited

U.S. PATENT DOCUMENTS

| | | | | | |
|---|---|---|---|---|---|
| 5,300,575 | A | | 4/1994 | Jonas et al. | 525/186 |
| 5,312,681 | A | | 5/1994 | Muys et al. | 430/427 |
| 5,354,613 | A | | 10/1994 | Quintens et al. | 428/341 |
| 5,370,981 | A | * | 12/1994 | Krafft et al. | 430/529 |
| 5,372,924 | A | | 12/1994 | Quintens et al. | 430/527 |
| 5,391,472 | A | | 2/1995 | Muys et al. | 430/527 |
| 5,403,467 | A | | 4/1995 | Jonas et al. | |
| 5,443,944 | A | * | 8/1995 | Krafft et al. | 430/529 |
| 5,575,898 | A | | 11/1996 | Wolf et al. | |
| 5,679,505 | A | * | 10/1997 | Tingler et al. | 430/429 |
| 6,096,491 | A | * | 8/2000 | Majumdar et al. | 430/529 |
| 6,124,083 | A | | 9/2000 | Majumdar et al. | 430/527 |
| 6,130,030 | A | * | 10/2000 | Anderson et al. | 430/529 |
| 6,140,030 | A | * | 10/2000 | Anderson et al. | 430/529 |

* cited by examiner

*Primary Examiner*—Richard L. Schilling
(74) *Attorney, Agent, or Firm*—Andrew J. Anderson

(57) ABSTRACT

A photographic imaging element is disclosed which comprises a support having on one side thereof at least one silver halide emulsion layer and having, in order, on the opposite side thereof an electrically-conductive layer coated from a coating composition comprising a polythiophene/polyanion composition containing a polythiophene with conjugated polymer backbone component and a polymeric polyanion component, and a protective topcoat comprised of a polyurethane binder which has a tensile elongation to break of at least 50% and a Young's modulus measured at 2% elongation of at least 50000 lb/in$^2$; wherein the electrical resistivity of the electrically-conductive layer before photographic processing is less than $2\times10^9$ Ω/□, after photographic processing is between $1\times10^9$ Ω/□ and $1\times10^{11}$ Ω/□, and increases by at least one order of magnitude as a result of photographic processing. Photographic imaging elements of the invention effectively minimize both raw (pre-photographic processing) static marking and processed (after photographic processing) photographic element sticking caused by the accumulation of electrostatic charges, and additionally have excellent resistance to scratch and abrasion.

18 Claims, 2 Drawing Sheets

PHOTOGRAPHIC ELEMENT CONTAINING AN ELECTRICALLY-CONDUCTIVE LAYER

FIELD OF THE INVENTION

The present invention relates to photographic imaging elements containing a support, one or more image forming layers, an electrically-conductive layer, and an abrasion resistant topcoat layer that overlies the electrically-conductive layer. More particularly, this invention relates to an imaging element especially suited for use as a motion picture print film that contains an electrically-conductive layer that undergoes a controlled shift in conductivity as a result of photographic processing. The motion picture film in accordance with preferred embodiments of the invention provides antistatic properties that are optimized for film manufacturing, printing, and projection.

BACKGROUND OF THE INVENTION

The problem of controlling electrostatic charge is well known in the field of photography. It is also generally known that electrostatic charge can usually be effectively controlled by incorporating an electrically-conductive "antistatic" layer into the film structure. An antistatic layer can be applied to either side of the film base as a subbing layer, that is, beneath the imaging layer or on the side opposite to the imaging layer (i.e., the backside of the film). An antistatic layer can alternatively be applied as an outer coated layer either over the emulsion layers or on the side of the film base opposite to the emulsion layers. For some applications, the antistatic agent can be incorporated into the emulsion layers. Alternatively, the antistatic agent can be directly incorporated into the film base itself. Typically, however, the antistatic layer is employed on the backside of the film and frequently it underlies an abrasion resistant, protective topcoat.

A wide variety of electrically-conductive materials can be incorporated into antistatic layers to produce a wide range of conductivity. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. These antistatic layers generally exhibit a substantial loss of antistatic function as a result of exposure to photographic processing solutions.

Antistatic layers containing electronic conductors such as conjugated conducting polymers, conducting carbon particles, crystalline semiconductor particles, amorphous semiconductive fibrils, and continuous semiconducting thin films can be used more effectively than ionic conductors to dissipate static charge since their electrical conductivity is independent of relative humidity and only slightly influenced by ambient temperature. The antistatic properties of such electronic conductors may or may not be affected by photographic processing depending on the particular material. Of the various types of electronic conductors, electrically conducting metal-containing particles, such as semiconducting metal oxides, are particularly effective when dispersed in suitable polymeric film-forming binders in combination with polymeric non-film-forming particles as described in U.S. Pat. Nos. 5,340,676; 5,466,567; 5,700,623.

Binary metal oxides doped with appropriate donor heteroatoms or containing oxygen deficiencies have been disclosed in prior art to be useful in antistatic layers for photographic elements, for example, U.S. Pat. Nos. 4,275,103; 4,416,963; 4,495,276; 4,394,441; 4,418,141; 4,431,764; 4,495,276; 4,571,361; 4,999,276; 5,122,445; 5,294,525; 5,382,494; 5,459,021; 5,484,694 and others. Suitable claimed conductive metal oxides include: zinc oxide, titania, tin oxide, alumina, indium oxide, silica, magnesia, zirconia, barium oxide, molybdenum trioxide, tungsten trioxide, and vanadium pentoxide. Preferred doped conductive metal oxide granular particles include antimony-doped tin oxide, fluorine-doped tin oxide, aluminum-doped zinc oxide, and niobium-doped titania. Additional preferred conductive ternary metal oxides disclosed in U.S. Pat. No. 5,368,995 include zinc antimonate and indium antimonate. Other conductive metal-containing granular particles including metal borides, carbides, nitrides and suicides have been disclosed in Japanese Kokai No. JP 04-055,492.

The generation and accumulation of electrostatic charge on film or paper surfaces leads to a variety of problems associated with the manufacture and use of these products. For example, electrostatic charge promotes the attraction of dirt and dust which can lead to these particles being imaged on the film during exposure or printed or projected when these particles are attracted to an already exposed and processed product such as a negative, slide, or motion picture print film. The discharge of accumulated charge during or after the application of the sensitized emulsion layer(s) can produce irregular fog patterns or "static marks" in the emulsion. The static problems have been aggravated by increases in the sensitivity of new emulsions, increases in coating machine speeds, and increases in post-coating drying efficiency. Electrostatic charge can accumulate during winding and unwinding operations, during transport through the coating machines and during finishing operations such as slitting and spooling. Electrostatic charge can also be generated during the use of the finished photographic film product. In an automatic camera, the winding of roll film in an out of the film cartridge, especially in a low relative humidity environment, can result in static charging. Similarly, high speed automated film processing can result in static charge generation. Sheet films (e.g., x-ray films) are especially susceptible to static charging during removal from light-tight packaging.

The use of conductive or antistatic layers on photographic products has greatly minimized many of these abovementioned problems associated with electrostatic charge. However, only very recently has it become recognized that the use of a conductive layer can actually exacerbate some static-related problems. When an electrostatic charge is generated on an insulating surface which overlies a buried conductive layer or is on the side of the film opposite to a conductive layer, the conductive layer is unable to dissipate this surface charge. Instead, the conductive layer can "image" the charge by polar charge formation (that is, the conductive layer is able to draw up an equal, but, opposite charge to that on the surface layer). The formation of this image charge or polar charge within the conductive layer effectively collapses the external field generated by the surface charge so that the field becomes internalized within the film. The presence of an external filed could otherwise attract airborne dirt and dust particles to the film surface which can lead to several problems already discussed. In this case then, the presence of the conductive layer and the formation of polar charge helps to eliminate a static-related problem, namely dirt and dust attraction. Referring now to FIG. 1 of the prior art, which schematically illustrates the cross-sectional view of an imaging element such as a photographic film, a polymer substrate 12 is provided with an insulating, image forming layer 10 on its front surface and a conductive layer 14 on its back surface. During conveyance of the imaging element, the image forming layer 10, as a result of contact with dissimilar materials such as rollers or other surfaces, may develop a positive electrostatic charge. The conductive layer 14 then forms an image charge so that the electric field E is internalized within the imaging element.

However, the formation of polar charge can lead to a variety of film sticking problems when the image charge within the conductive layer on one side of the film couples to the (opposite sign) surface charge on the other side of an adjacent lap of film within a roll or on another sheet of film that it is in contact with. Referring now to FIG. 2 of the prior art, which schematically illustrates this film sticking phenomenon, a film segment 20 which may be present as a sheet of film or a lap of film on a roll, contains a polymer substrate 26, an insulating, image forming layer 24 on its front surface and a conductive layer 28 on its back surface. Likewise, a film segment 20', which again may be present as a sheet of film or a lap of film on a roll which is adjacent to film segment 20, contains a polymer substrate 26', an image forming layer 24', and a conductive layer 28'. Both film segments 20 and 20' have a positive surface charge on imaging layers 24 and 24', respectively, and an image charge in the conductive layers 28 and 28', respectively.

An electrostatic attraction force exists between the positively charged image forming layer 24' of film segment 20' and the negatively charged conductive layer 28 of film segment 20. This force of attraction increases as the distance between the two film segments is decreased and results in the sticking together of these two sheets of film or alternatively two adjacent laps of film. Examples where this film sticking has been observed include sheet films such as graphic arts films, microfiche, and x-ray films that contain a conductive layer whose conductive properties survive film processing. Such films become charged as a result of contact with rollers during film processing and can cause jams in the film processor or difficulties in handling the films after processing.

For motion picture print films containing a conductive layer such as those described in U.S. Pat. Nos. 5,679,505 and 6,096,491, for example, film sticking may cause jams in film projectors employing endless loop or automated platter systems such as those described in U.S. Pat. Nos. 4,186,891, 4,208,018, and others. Referring now to FIG. 3 of the prior art, which schematically illustrates this platter sticking problem, an automated platter system 30 contains an inner lap of film 32 which is pulled from the core of the film roll and transported along film path 36 to the film projector. The film is rewound onto the outer lap of the film roll via film path 38 as it returns from the projector. As a result of film sticking due to the process already described in FIG. 2, when inner lap 32 is drawn from the core of the roll it may stick to the adjacent lap 34. Film lap 34 may in turn stick to the adjacent outer lap, and so on. Thus multiple laps of film may be pulled simultaneously from the core of the film roll and become jammed in the platter system potentially damaging the projector system, the film, or both.

Increasing the resistivity (or decreasing the conductivity) of a conductive or antistatic layer contained on an imaging element such as a motion picture print film to greater than about $1\times10^9$ Ω/□, and especially greater than $2.5\times10^9$ Ω/□, can significantly reduce the tendency for the above sticking problems. However, by increasing the resistivity of the conductive layer above $2\times10^9$ Ω/□, one may also significantly reduce overall antistatic protection provided by the conductive layer. In particular, the layer may not be sufficiently conductive to prevent static marking of the raw film during high speed manufacturing operations such as film slitting, chopping, or perforating. These high resistivity values may result in static marking or dirt attraction during high speed printing (at speeds of 2000 feet/min or more) of a motion picture print film, thereby degrading print quality. Although it may be possible to carefully optimize the resistivity of the film so that static protection during manufacturing and printing is provided while processed film sticking is eliminated, simultaneously achieving both of these attributes is a very difficult challenge.

U.S. Pat. No. 6,140,030 describes a possible solution to the above problem by providing an imaging element containing two different electrically-conductive agents which allows the element to be highly conductive before film processing and only moderately conductive after film processing. However, it would be desirable to provide such features without the associated cost and manufacturing complexity of incorporating two electrically-conductive agents in the film.

U.S. Pat. No. 5,679,505 describes an imaging element especially designed for use as a motion picture film containing an antistatic agent and a protective topcoat containing a polyurethane binder, the film preferably having an electrical resistivity of from about 7 to 11 log Ω/□, and most preferably less than 9 log Ω/□. The '505 patent did not recognize the particular problem that is addressed by the present invention.

U.S. Pat. No. 6,096,491 describes imaging elements, including motion imaging films, containing an electrically conductive layer protected under an abrasion resistant topcoat. The electrically-conductive layer may comprise an electrically conductive 3,4-dialkoxy substituted polythiophene styrene sulfonate complex. The '491 patent, however, did not recognize the particular problem that is addressed by the present invention, and rather teaches electrically-conductive layer compositions whose electrical resistivity remains substantially unchanged as a result of photographic film processing. Such films are typically too highly conductive after processing for the purpose of the present invention.

SUMMARY OF THE INVENTION

It is an object of the present invention to provide an improved photographic imaging element which effectively minimizes both raw (pre-photographic processing) film static marking and processed (after photographic processing) photographic element sticking caused by the accumulation of electrostatic charges.

It is a further object of the present invention to provide an improved photographic imaging element that additionally has excellent resistance to scratch and abrasion.

In accordance with the present invention an imaging element comprises a support having on one side thereof at least one silver halide emulsion layer and having, in order, on the opposite side thereof an electrically-conductive layer coated from a coating composition comprising a polythiophene/polyanion composition containing a polythiophene with conjugated polymer backbone component and a polymeric polyanion component, and a protective topcoat comprised of a polyurethane binder which has a tensile elongation to break of at least 50% and a Young's modulus measured at 2% elongation of at least 50000 lb/in$^2$; wherein the electrical resistivity of the electrically-conductive layer before photographic processing is less than $2\times10^9$ Ω/□, after photographic processing is between $1\times10^9$ Ω/□ and $1\times10^{11}$ Ω/□, and increases by at least one order of magnitude as a result of photographic processing.

Photographic imaging elements of the invention provide optimum antistatic protection during all phases of manufacture and use.

DETAILED DESCRIPTION OF THE INVENTION

Figure 1:
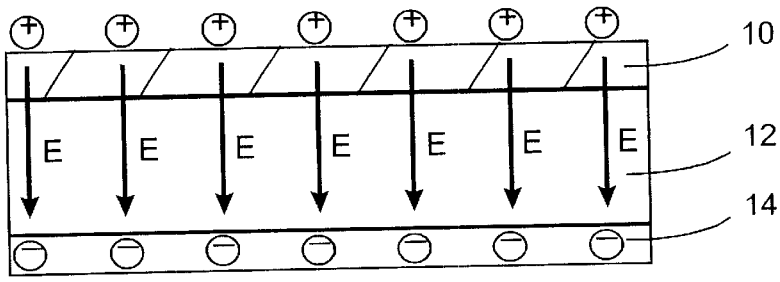
FIG. 1 (PRIOR ART)
FIG. 1 is a schematic diagram of the cross-section of an imaging element of the prior art.
Figure 2:
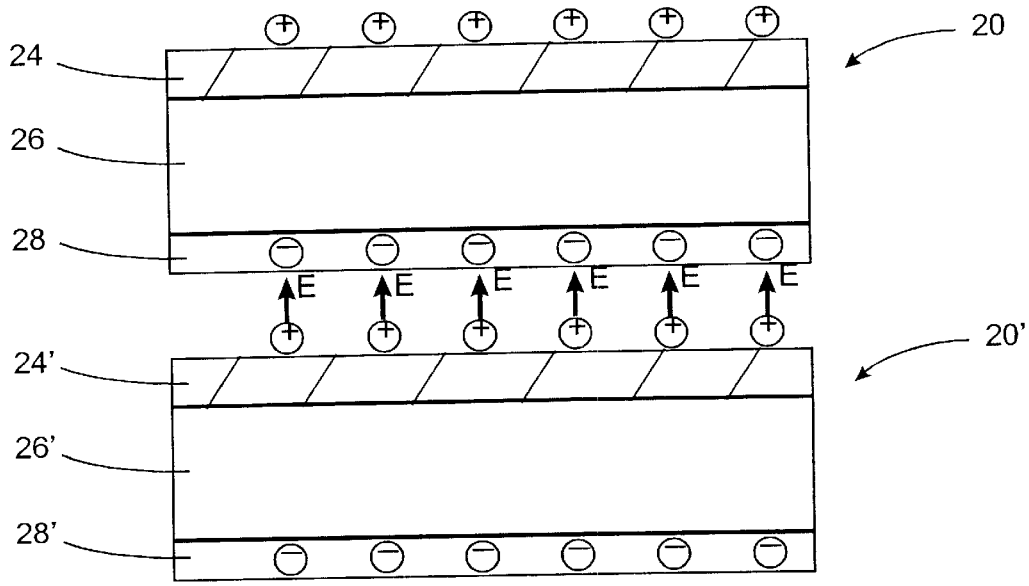
FIG. 2 (PRIOR ART)
FIG. 2 is a schematic diagram showing two films of the prior art sticking together as a result of electrostatic attraction.
Figure 3:
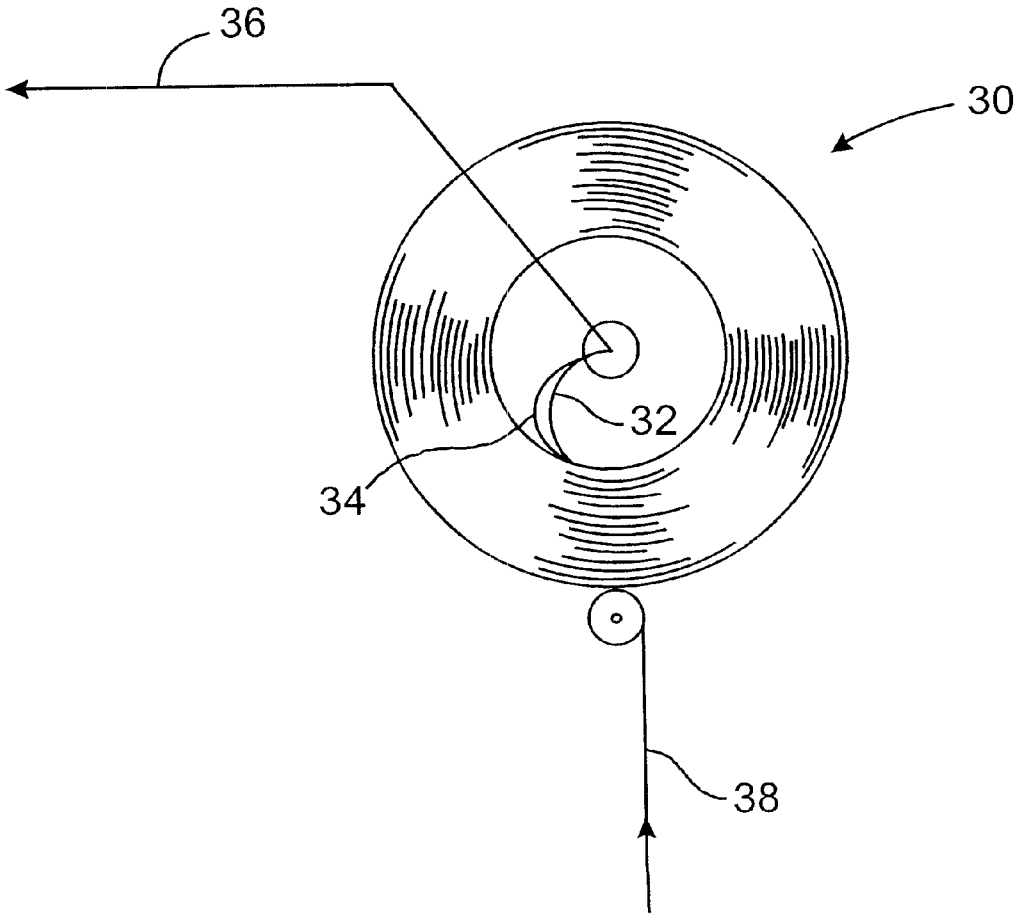
FIG. 3 (PRIOR ART)
FIG. 3 is a schematic diagram showing how a film of the prior art can create jams in a motion picture projector automated platter system.

The present invention relates to a photographic element comprising a support having on one side thereof at least one silver halide emulsion layer and having, in order, on the opposite side thereof an electrically-conductive layer and a protective topcoat; wherein the electrically-conductive layer is designed such that its electrical resistivity increases by at least one order of magnitude as a result of photographic processing and, further, before photographic processing the electrical resistivity is less than $2\times10^9$ Ω/□ and after photographic processing the electrical resistivity is between $1\times10^9$ Ω/□ and $1\times10^{11}$ Ω/□. Thus the element of the invention is highly conductive before photographic processing and provides excellent protection from static marking and dirt and dust attraction during high speed manufacturing operations such as photographic film slitting and perforating and during high speed printing. After processing the photographic element becomes somewhat less conductive (i.e., resistivity is increased by at least one order of magnitude) so that problems associated with photographic film sticking/static cling during projection is eliminated while the photographic film is still sufficiently conductive (electrical resistivity is maintained below $1\times10^{11}$ Ω/□) to control dirt and dust attraction.

The support materials used in the practice of the invention can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. The thickness of the support is not critical. Support thickness of 2 to 10 mils (0.002–0.010 inches) can be employed, for example, with very satisfactory results. To promote adhesion, an undercoat or primer layer is typically employed on polyester support. Such undercoat layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088, 2,698,235, 2,698,240, 2,943,937, 3,143,421, 3,201,249, 3,271,178 and 3,501,301.

In a particularly preferred embodiment, the imaging element of this invention is a photographic film in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements or they can be multilayer and/or multicolor elements. References to photographic processing of such elements to provide a controlled shift in electrical resistivity of the electrically-conductive layer in accordance with the invention is intended to refer to employment of a standard photographic process for which the element is designed. The general sequence of steps and conditions (times and temperatures) for standard photographic processing of various types of photographic elements are well known, such as Process C-41 and Process ECN-2 for color negative films, Process E-6 and Process K-14 for color reversal films, Process ECP for motion picture color print films, and Process RA-4 for color papers.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A typical multicolor motion picture photographic print film element in accordance with preferred embodiments of the invention comprises a support bearing, in order, a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler. Each of the cyan, magenta, and yellow image forming units may be comprised of a single light-sensitive layer, a pack of two light-sensitive layers with one being more light sensitive and the other being less light-sensitive, or a pack of three or more light-sensitive layers of varying light-sensitivity. Motion picture color print films may be photographically processed in commercial motion picture color print film processors, using the standard ECP-2B photoprocess, which is described in Kodak Publication No. H-24, The Kodak ECP-2B Process, Manual for Processing Eastman Color films. In a preferred embodiment, a motion picture color print film element comprising an electrically conductive layer in accordance with the invention is provided wherein the electrical resistivity of the electrically-conductive layer before photographic processing is less than $2\times10^9$ Ω/□, after standard ECP-2B photographic processing is between $1\times10^9$ Ω/□ and $1\times10$ Ω/□, and increases by at least one order of magnitude as a result of standard ECP-2B photographic processing. In an especially preferred embodiment, the electrical resistivity of the electrically-conductive layer of such element after photographic processing in the standard ECP-2B process is between $2.5\times10^{9}$ Ω/□ and $1\times10^{11}$ Ω/□.

As indicated above, the standard Kodak ECP-2B Color Print Development Process is described in the Kodak Publication No. H-24 Manual. The process, excluding steps specific to sound track development, consists of a prebath (10"), water rinse (20"), color developer (3'), stop bath (40"), first wash (40"), first fix (40"), second wash (40"), ferricyanide bleach (1'), third wash (40"), second fix (40"), fourth wash (1'), final rinse (10"), and then drying with hot air.

| | |
|---|---|
| The BCP-2B Prebath consists of: | |
| Water | 800 mL |
| Borax (decahydrate) | 20.0 g |
| Sodium sulfate (anhydrous) | 100.0 g |
| Sodium hydroxide | 1.0 g |
| Water to make 1 liter | |
| pH @ 26.7° C. is 9.25 +/− 0.10 | |
| The ECP-2B Color Developer consists of: | |
| Water | 900 mL |
| Kodak Anti-Calcium, No. 4 (40% solution of a pentasodium salt of nitrilo-tri(methylene phosphonic acid) | 1.00 mL |
| Sodium sulfite (anhydrous) | 4.35 g |
| Sodium bromide (anhydrous) | 1.72 g |
| Sodium carbonate (anhydrous) | 17.1 g |
| Kodak Color Developing Agent, CD-2 | 2.95 g |
| Sulfuric acid (7.0 N) | 0.62 mL |
| Water to make 1 liter | |
| pH @ 26.7° C. is 10.53 +/− 0.05 | |
| The ECP-2B Stop Bath consists of: | |
| Water | 900 mL |
| Sulfuric acid (7.0 N) | 50 mL |
| Water to make 1 liter | |
| pH @ 26.7° C. is 0.90 | |
| The ECP-2B Fixer consists of: | |
| Water | 800 mL |
| Ammonium thiosulfate (58.0% solution) | 100.0 mL |
| Sodium bisulfate (anhydrous) | 13.0 g |
| Water to make 1 liter | |
| pH @ 26.7° C. is 5.00 +/− 0.15 | |
| The ECP-2B Ferricyanide Bleach consists of: | |
| Water | 900 mL |
| Potassium ferricyanide | 30.0 g |
| Sodium bromide (anhydrous) | 17.0 g |
| Water to make 1 liter | |
| pH @ 26.7° C. is 6.50 +/− 0.05 | |
| The Final Rinse solution consists of: | |
| Water | 900 mL |
| Kodak Photo-Flo 200 (TM) Solution | 3.0 mL |
| Water to make 1 liter | |

Standard ECP-2B processing is done with the color developing solution adjusted to 98.0° F. (36.7° C.), and the stopping, fixing, bleaching, washing, and final rinsing solution temperatures adjusted to 80° F. (26.7° C.).

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. Photographic print films typically use relatively small grain, high chloride emulsions (e.g., emulsions having average grain size equivalent circular diameters of less than about 1 micron and halide contents of greater than 50 mole % chloride) in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that motion picture color print films, e.g., when rated using the same international standards criteria used for rating camera negative films, would typically have an ISO speed rating of less than 10, which is several stops slower than the slowest camera negative films in current use. The emulsions typically will be gelatin emulsions although other hydrophilic colloids can be used in accordance with usual practice. The compositions of typical light sensitive image recording layers used in print films are well known, and are not critical to the invention, as any of the silver halide materials used in conventional motion picture films may be used, such as those described, e.g., in *Research Disclosure*, Item 36544, September, 1994, and the references listed therein.

The photographic silver halide emulsions utilized in this invention can contain other addenda conventional in the photographic art. Useful addenda are described, for example, in *Research Disclosure*, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The antistatic layer of the present invention is coated from a coating composition comprising a polythiophene/polyanion composition containing an electrically conductive polythiophene with conjugated polymer backbone component and a polymeric polyanion component. A preferred polythiophene component for use in accordance with the present invention contains thiophene nuclei substituted with at least one alkoxy group, e.g., a $C_1$–$C_{12}$ alkoxy group or a —$O(CH_2CH_2O)_nCH_3$ group, with n being 1 to 4, or where the thiophene nucleus is ring closed over two oxygen atoms with an alkylene group including such group in substituted form. Preferred polythiophenes for use in accordance with the present invention may be made up of structural units corresponding to the following general formula (I)

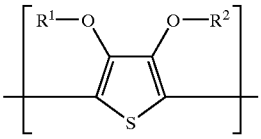

in which: each of $R^1$ and $R^2$ independently represents hydrogen or a $C_{1-4}$ alkyl group or together represent an optionally substituted $C_{1-4}$ alkylene group, preferably an ethylene group, an optionally alkyl-substituted methylene group, an optionally $C_{1-2}$ alkyl- or phenyl-substituted 1,2-ethylene group, 1,3-propylene group or 1,2-cyclohexylene group. The preparation of electrically conductive polythiophene/polyanion compositions and of aqueous dispersions of polythiophenes synthesized in the presence of polyanions, as well as the production of antistatic coatings from such dispersions is described in EP 0 440 957 (and corresponding U.S. Pat. No. 5,300,575), as well as, for example, in U.S. Pat. Nos. 5,312,681; 5,354,613; 5,370,981; 5,372,924; 5,391,472; 5,403,467; 5,443,944; and 5,575,898, the disclosures of which are incorporated by reference herein.

The preparation of an electrically conductive polythiophene in the presence of a polymeric polyanion compound may proceed, e.g., by oxidative polymerization of 3,4-dialkoxythiophenes or 3,4-alkylenedioxythiophenes according to the following general formula (II):

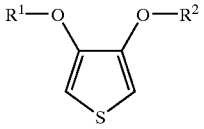

wherein: $R^1$ and $R^2$ are as defined in general formula (I), with oxidizing agents typically used for the oxidative polymerization of pyrrole and/or with oxygen or air in the presence of polyacids, preferably in aqueous medium containing optionally a certain amount of organic solvents, at temperatures of 00 to 10000 C.

The polythiophenes get positive charges by the oxidative polymerization, the location and number of said charges is not determinable with certainty and therefore they are not mentioned in the general formula of the repeating units of the polythiophene polymer. When using air or oxygen as the oxidizing agent their introduction proceeds into a solution containing thiophene, polyacid, and optionally catalytic quantities of metal salts till the polymerization is complete.

Oxidizing agents suitable for the oxidative polymerization of pyrrole are described, for example, in J. Am. Soc. 85, 454 (1963). Inexpensive and easy-to-handle oxidizing agents are preferred such as iron(III) salts, e.g. $FeCl_3$, $Fe(ClO_4)_3$ and the iron(III) salts of organic acids and inorganic acids containing organic residues, likewise $H_2O_2$, $K_2Cr_2O_7$, alkali or ammonium persulfates, alkali perborates, potassium permanganate and copper salts such as copper tetrafluoroborate. Theoretically, 2.25 equivalents of oxidizing agent per mol of thiophene are required for the oxidative polymerization thereof (ref. J. Polym.Sci. Part A, Polymer Chemistry, Vol. 26, p.1287 (1988)). In practice, however, the oxidizing agent is used in a certain excess, for example, in excess of 0.1 to 2 equivalents per mol of thiophene.

For the polymerization, thiophenes corresponding to the above general formula (II), a polyacid and oxidizing agent may be dissolved or emulsified in an organic solvent or preferably in water and the resulting solution or emulsion is stirred at the envisaged polymerization temperature until the polymerization reaction is completed. The weight ratio of polythiophene polymer component to polymeric polyanion component(s) in the polythiophene/polyanion compositions employed in the present invention can vary widely, for example preferably from about 50/50 to 15/85. By that technique stable aqueous polythiophene/polyanion dispersions are obtained having a solids content of 0.5 to 55% by weight and preferably of 1 to 10% by weight. The polymerization time may be between a few minutes and 30 hours, depending on the size of the batch, the polymerization temperature and the kind of oxidizing agent. The stability of the obtained polythiophene/polyanion composition dispersion may be improved during and/or after the polymerization by the addition of dispersing agents, e.g. anionic surface active agents such as dodecyl sulfonate, alkylaryl polyether sulfonates described in U.S. Pat. No. 3,525,621. The size of the polymer particles in the dispersion is typically in the range of from 5 nm to 1 $\mu$m, preferably in the range of 40 to 400 nm.

Polyanions used in the synthesis of these electrically conducting polymers are the anions of polymeric carboxylic acids such as polyacrylic acids,polymethacrylic acids or polymaleic acids and polymeric sulfonic acids such as polystyrenesulfonic acids and polyvinylsulfonic acids, the polymeric sulfonic acids being those preferred for this invention. These polycarboxylic and polysulfonic acids may also be copolymers of vinylcarboxylic and vinylsulfonic acids with other polymerizable monomers such as the esters of acrylic acid and styrene. The anionic (acidic) polymers used in conjunction with the dispersed polythiophene polymer have preferably a content of anionic groups of more than 2% by weight with respect to said polymer compounds to ensure sufficient stability of the dispersion. The molecular weight of the polyacids providing the polyanions preferably is 1,000 to 2,000,000, particularly preferably 2,000 to 500,000. The polyacids or their alkali salts are commonly available, e.g., polystyrenesulfonic acids and polyacrylic acids, or they may be produced based on known methods. Instead of the free acids required for the formation of the electrically conducting polymers and polyanions, mixtures of alkali salts of polyacids and appropriate amounts of monoacids may also be used.

While general synthesis procedures and compositions are described above, the polythiophene/polyanion compositions employed in the present invention are not new themselves, and are commercially available. Preferred electrically-conductive polythiophene/polyanion polymer compositions for use in the present invention include 3,4-dialkoxy substituted polythiophene/poly(styrene sulfonate), with the most preferred electrically-conductive polythiophene/polyanion polymer composition being poly(3,4-ethylene dioxythiophene)/poly(styrene sulfonate), which is available commercially from Bayer Corporation as Baytron P.

Any polymeric film-fonning binder, including water soluble polymers, synthetic latex polymers such as acrylics, styrenes, acrylonitriles, vinyl halides, butadienes, and others, or water dispersible condensation polymers such as polyurethanes, polyesters, polyester ionomers, polyamides, epoxides, and the like, may be optionally employed in the conductive layer to improve integrity of the conductive layer and to improve adhesion of the antistatic layer to an underlying and/or overlying layer. Preferred binders include polyester ionomers, vinylidene chloride containing interpolymers and sulfonated polyurethanes as disclosed in U.S. Pat. No. 6,124,083 incorporated herein by reference. The electrically-conductive polythiophene/polyanion composition to added binder weight ratio can vary from 100:0 to 0.1:99.9, preferably from 1:1 to 1:20, and more preferably from 1:2 to 1:20. The dry coverage of the electrically-conductive substituted or unsubstituted thiophene-containing polymer employed depends on the inherent conductivity of the electrically-conductive polymer and the electrically-conductive polymer to binder weight ratio. A preferred range of dry coverage for the electrically-conductive substituted or unsubstituted thiophene-containing polymer component of the polythiophene/polyanion compositions is from about 0.5 mg/m$^2$ to about 3.5 mg/m$^2$, this dry coverage should provide the desired electrical resistivity values before and after photographic processing while minimizing the impact of the electrically-conductive polymer on the color and optical density of the processed photographic element.

In addition to the electrically-conductive agent(s) and polymeric binder, the electrically-conductive layers of the invention may include crosslinking agents, coating aids and surfactants, dispersing aids, coalescing aids, biocides, matte particles, waxes and other lubricants. A common level of coating aid in the conductive coating formula, e.g., is 0.01 to 0.3 weight % active coating aid based on the total solution weight. These coating aids are typically either anionic or nonionic and can be chosen from many that are applied for aqueous coating. The various ingredients of the coating solution may benefit from pH adjustment prior to mixing, to insure compatibility. Commonly used agents for pH adjustment are ammonium hydroxide, sodium hydroxide, potassium hydroxide, tetraethyl amine, sulfuric acid, acetic acid, etc.

The electrically-conductive layers of the invention may be applied from either aqueous or organic solvent coating formulations using any of the known coating techniques such as roller coating, gravure coating, air knife coating, rod coating, extrusion coating, blade coating, curtain coating, slide coating, and the like. After coating, the layers are generally dried by simple evaporation, which can be accelerated by known techniques such as convection heating. Known coating and drying methods are described in further detail in Research Disclosure No. 308119, Published December 1989, pages 1007 to 1008.

The electrically-conductive layer of this invention is overcoated with a polyurethane such as those described in U.S. Pat. No. 5,679,505, which is incorporated herein by reference. Aliphatic polyurethanes are preferred due to their excellent thermal and UV stability and freedom from yellowing. The polyurethane employed in the topcoat of the present invention is characterized as having a tensile elongation to break of at least 50% and a Young's modulus measured at an elongation of 2% of at least 50,000 lb/in$^2$. These physical property requirements insure that the topcoat layer is hard yet tough to simultaneously provide excellent abrasion resistance and outstanding resiliency. In accordance with preferred embodiments of the invention, such topcoat and antistat layer is able to survive hundreds of cycles through a motion picture projector. The polyurethane topcoat is preferably coated from a coating formula containing from about 0.5 to about 10.0 weight percent of polymer to give a dry coverage of from about 50 to about 3000 mg/m$^2$. The dry coverage of the topcoat layer is preferably from about 300 to 2000 mg/m$^2$. In accordance with a specifically preferred embodiment of the invention, Sancure 898™ polyurethane (available from B.F.Goodrich Corp.) is employed as the polyurethane topcoat binder.

The polyurethane may be either organic solvent soluble or aqueous dispersible. For environmental reasons, aqueous dispersible polyurethanes are preferred. Preparation of aqueous polyurethane dispersions is well-known in the art and involves chain extending an aqueous dispersion of a prepolymer containing terminal isocyanate groups by reaction with a diarnine or diol. The prepolymer is prepared by reacting a polyester, polyether, polycarbonate, or polyacrylate having terminal hydroxyl groups with excess polyfunctional isocyanate. This product is then treated with a compound that has functional groups that are reactive with an isocyanate, for example, hydroxyl groups, and a group that is capable of forming an anion, typically this is a carboxylic acid group. The anionic groups are then neutralized with a tertiary amine to form the aqueous prepolymer dispersion. The physical properties of the polyurethane topcoat can be improved by adding a crosslinking agent that reacts with functional groups present in the polyurethane, for example, carboxyl groups. Crosslinking agents such as aziridines, carbodiimides, epoxies, and the like are suitable for this purpose. The crosslinking agent can typically be used at 0 to 30 weight percent based on the polyurethane. However, a crosslinking agent concentration of about 0 to 8 weight percent based on the polyurethane is preferred.

A suitable lubricating agent is preferably included in the topcoat, selected to give the topcoat a coefficient of friction that ensures good transport characteristics during manufacturing and customer handling of the photographic film. Many lubricating agent can be used including higher alcohol esters of fatty acid, higher fatty acid calcium salts, metal stearates, silicone compounds, paraffins and the like as described in U.S. Pat. Nos. 2,588,756, 3,121,060, 3,295,979, 3,042,522 and 3,489,567 hereby incorporated herein by reference and the like. For satisfactory transport characteristics, the lubricated surface preferably has a coefficient of friction from 0.10 to 0.40. However, the most preferred range is 0.15 to 0.30. If the topcoat coefficient of friction is below 0.15, there is a significant danger that long, slit rolls of the photographic film will become unstable in storage or shipping and become telescoped or dished, a condition common to unstable film rolls. If the coefficient of friction is above 0.30 at manufacture or becomes greater than 0.30 after photographic film processing, a common condition of non-process surviving topcoat lubricants, the photographic film transport characteristics become poorer, particularity in some types of photographic film projectors.

Aqueous dispersed lubricants are strongly preferred since lubricants, in this form, can be incorporated directly into the aqueous protective top formula, thus avoiding a separately applied lubricant overcoat on the protective overcoat layer. The aqueous dispersed lubricants of carnauba wax, polyethylene oxide, microcrystalline wax, paraffin wax, silicones, stearates and amides work well as incorporated lubricants in the aqueous, protective topcoat. However, the aqueous dispersed lubricants of carnauba wax and stearates are preferred for their effectiveness in controlling friction at low lubricant levels and their excellent compatibility with aqueous dispersed polyurethanes.

Preferably, the topcoats of the present invention contain matte particles. In addition to lubricants, matting agents are important for improving the transport of the film on manufacturing, printing, processing, and projecting equipment. Also, these matting agents can reduce the potential for the protective topcoat to ferrotype when in contact with the emulsion side surface under the pressures that are typical of roll films. The term ferrotyping is used to describe the condition in which the backside protective topcoat, when in contact with the emulsion side under pressure, as in a tightly wound roll, adheres to the emulsion side protective overcoat layer sufficiently strong that some sticking is noticed between the protective topcoat and the emulsion side surface layer when they are separated. In severe cases of ferrotyping, damage to the emulsion side surface may occur when the protective topcoat and emulsion protective overcoat are separated. This severe damage may have a sensitometric effect on the emulsion. The matting agent may be silica, calcium carbonate, or other mineral oxides, glass spheres, ground polymers and high melting point waxes, and polymeric matte beads. These polymeric matte beads are preferred because of uniformity of shape and uniformity of size distribution. The matte particles should have a mean diameter size of about 0.5 to about 3 micrometer. However, preferably the matte particles have a mean diameter from about 0.75 to about 2.5 micrometers. The matte particles can be employed at a dry coating weight of about 1 to about 100 mg/m$^2$. However, the preferred coating weight of the matte particles is about 2.5 to about 65 mg/m$^2$. The surface roughness (Ra, ANSI Standard B46.1, 1985) in microns should be in the range 0.005 to 0.060 to prevent ferrotyping of the emulsion surface. If the Ra value is below 0.005, there is insufficient surface roughness to prevent slight emulsion surface marking from ferrotyping between the backing and emulsion. If the Ra value is above 0.060, there is sufficient surface roughness with these size matte particles to show some low level of emulsion granularity and loss of picture sharpness, especially under the very high magnifications typical of movie theater projection. The preferred Ra value range is from 0.010 to 0.035 for best performance. In order to provide motion picture print film elements demonstrating excellent protection from ferrotyping, freedom from dirt and abrasion, and excellent image quality and soundtrack reproduction, combinations of permanent (non photographic processing solution soluble) and soluble (designed to be removed during photographic processing) matting agents at specific levels may be employed as described in copending, commonly assigned U.S. Ser. No. 09/473,419, the disclosure of which is incorporated herein by reference.

The present invention will now be described in detail with reference to specific examples, however, the present invention should not be limited to these examples.

EXAMPLES

Print Film Samples Were Prepared as Follows:

Subbed poly(ethylene terephthalate) supports were prepared by first applying a subbing layer comprising a vinylidene chloride copolymer to both sides of a support before drafting and tentering so that the final dried coating weight of the subbing layer was about 90 mg/m$^2$.

An electrically-conductive layer was applied onto one side of the support having the compositions listed in Table 1. The electrically-conductive agent used in the coatings of the invention was Baytron P™ (poly(3,4-ethylene dioxythiophene)/poly(styrene sulfonate), available from Bayer Corporation), which was supplied in the form of an aqueous dispersion comprising 0.5 wt % poly(3,4-ethylene dioxythiophene) ("PEDOT") and 0.8 wt % poly(styrene sulfonate) ("PSS"). Comparative samples employed either antimony-doped tin oxide particles (Ishihara Sangyo Kaisha Ltd SN100D) or silver-doped vanadium pentoxide fibers (similarly as described in U.S. Pat. No. 5,679,505) as the electrically-conductive agent.

A protective topcoat having the following general composition was applied onto the electrically-conductive layer of each sample:

| | |
|---|---|
| Sancure 898 polyurethane binder (B.F. Goodrich Corp., modulus = 115,000 lb/in$^2$, elongation to break = 210%)) | 900 mg/m$^2$ |
| CX100 polyfunctional aziridine crosslinker (Zeneca Resins) | 0 or 56 mg/m$^2$ (see Table 1) |
| Coating Surfactant | 24 mg/m$^2$ |
| Michemlube 160 carnauba wax (Michelman, Inc.) | 12 mg/m$^2$ |
| Polymer matte (polymethylmethacrylate beads, avg. size = 1.5 $\mu$m) | 2.5 mg/m$^2$ |

A conventional gelatin subbing layer was applied onto the vinylidene chloride copolymer subbing layer on the side of the support opposite to the electrically-conductive layer and protective topcoat. Then silver halide emulsion layers suitable for color motion picture print film (a yellow dye image-forming unit comprising a blue-sensitive silver halide emulsion layer having associated therewith a yellow dye-forming coupler, a cyan dye image-forming unit comprised of a red-sensitive silver halide emulsion layer having associated therewith a cyan dye-forming coupler, and a magenta dye image-forming unit comprising a green-sensitive silver halide emulsion layer having associated therewith a magenta dye-forming coupler, similarly as described in Example 2 of copending, commonly assigned U.S. Ser. No. 09/208,894 filed Dec. 10, 1998, the disclosure of which is incorporated by reference herein), and a protective overcoat having the following general composition was applied over the emulsion layer for each sample:

| | |
|---|---|
| Deionized gelatin | 907 mg/m$^2$ |
| Polydimethylsiloxane lubricant (Dow Corning) | 15 mg/m$^2$ |
| Polymer matte (polymethylmethacrylate beads, avg. size = 1.5 $\mu$m) | 15 mg/m$^2$ |
| Charge control surfactant (FT-248 fluorosurfactant, Bayer) | 7.5 mg/m$^2$ |
| Coating surfactant | 20 mg/m$^2$ |

The Following Tests Were Conducted:

The electrical resistivity of the samples before and after photographic film processing was measured at 20% RH using the procedures described in R. A. Elder, "Resistivity Measurements on Buried Conductive Layers", EOS/ESD Symposium proceedings, September 1990, pages 251–254. The samples were processed in a motion picture color print film processor (the photo-process is described in Kodak Publication No. H-24, The Kodak ECP-2B Process, Manual for Processing Eastman Color films).

The propensity of the film to develop static marks due to electrostatic charge buildup and discharge during high speed film manufacturing operations and printing was evaluated by: 1) conveying the raw film sample as a continuous (52 inch long) loop of film over 2 polyurethane positive transfer rollers (PTR rollers) and one aluminum-coated roller at 1600 feet per minute under dark conditions for a total of 2 minutes, one loop of each film sample was conveyed so that the emulsion side was in contact with the PTR rollers and a second loop of each film sample was conveyed so that the backside of the film was in contact with the PTR rollers; 2) processing the films in a motion picture color print film processor; and 3) inspecting the processed film for evidence of static marks.

The propensity of the film to exhibit static cling during projection using an automated platter system was evaluated by conveying a processed film through a laboratory apparatus designed to simulate a projection system employing an automated platter system for 10 cycles and counting the number of times that multiple laps of film were pulled from the platter system that could result in projector jams.

Abrasion resistance in a motion picture projector was evaluated from a continuous loop of processed film sample that had been passed through a motion picture film projector for 100 passes to simulate the normal film life in a movie theater. The tested film was removed from the projector and examined in an optical microscope for abrasion and scratches on the film in the areas where the film surfaces were in contact with the projector. The films were rated on a scale of 1 to 5 with 1 being excellent performance and 5 being poor performance.

TABLE 1

| | Electrically-Conductive Layer Composition | | Electrical Resistivity | |
|---|---|---|---|---|
| | | | Before | After |
| Sample | Conductive agent ($mg/m^2$) | Polymer Binder ($mg/m^2$) | Processing (Ω/□) | Processing (Ω/□) |
| Example 1* | Baytron P (5.5) (PEDOT (2.1) + PSS (3.4)) | Eastman Chemical AQ29D polyesterionomer (44) | $3.6 \times 10^8$ | $2.0 \times 10^{10}$ |
| Example 2** | Baytron P (5.5) (PEDOT(2.1) + PSS (3.4)) | Eastman Chemical AQ29D (44) | $6.2 \times 10^8$ | $2.0 \times 10^{10}$ |
| Example 3* | Baytron P (6.0) (PEDOT (2.3) + PSS (3.7)) | Eastman Chemical AQ29D (48) | $1.2 \times 10^8$ | $6.3 \times 10^9$ |
| Example 4** | Baytron P (6.0) (PEDOT (2.3) + PSS (3.7)) | Eastman Chemical AQ29D (48) | $1.9 \times 10^8$ | $9.5 \times 10^9$ |
| Examples 5* | Baytron P (7.0) (PEDOT (2.7) + PSS (4.3)) | Eastman Chemical AQ29D (56) | $2.7 \times 10^7$ | $1.1 \times 10^9$ |
| Example 6** | Baytron P (7.0) (PEDOT(2.7) + PSS (4.3)) | Eastman Chemical AQ29D (56) | $6.0 \times 10^7$ | $3.1 \times 10^9$ |
| Example 7** | Baytron P (5.0) (PEDOT (1.9) + PSS (3.1)) | Eastman Chemical AQ29D (5.0) | $5.5 \times 10^8$ | $1.0 \times 10^{10}$ |
| Example 8** | Baytron P (6.0) (PEDOT (2.3) + PSS (3.7)) | Eastman Chemical AQ29D (6.0) | $6.0 \times 10^7$ | $1.7 \times 10^9$ |
| Comparative Sample A* | Sb-doped tin oxide (13.5) | Sancure 898 polyurethane (1.5) | $6.3 \times 10^8$ | $7.9 \times 10^7$ |
| Comparative Sample B** | Sb-doped tin oxide (13.5) | Sancure 898 polyurethane (1.5) | $4.0 \times 10^8$ | $6.3 \times 10^7$ |
| Comparative Sample C* | Ag-doped vanadium pentoxide (3) | vinylidene chloride copolymer latex (3) | $4.0 \times 10^8$ | >3 × 1012 |
| Comparative Sample D** | Ag-doped vanadium pentoxide (3) | vinylidene chloride copolymer latex (3) | $4.0 \times 10^8$ | $3.0 \times 10^8$ |
| Comparative Sample E** | Ag-doped vanadium pentoxide (2) | vinylidene chloride copolymer latex (2) | $4.5 \times 10^9$ | $6.7 \times 10^8$ |
| Comparative Sample F* | Baytron P (10.0) (PEDOT (3.8) + PSS (6.2)) | Eastman Chemical AQ29D (10) | $2.5 \times 10^7$ | $1.9 \times 10^8$ |

*topcoat layer contains 0 $mg/m^2$ of CX100 aziridine crosslinker, i.e., polyurethane binder is uncrosslinked.
**topcoat layer contains 56 $mg/m^2$ of CX100 aziridine crosslinker, i.e., polyurethane binder is crosslinked.

The results presented in Table 1 show that photographic elements of the invention (Examples 1 to 6) having an electrically-conductive layer containing a polythiophene component (PEDOT) at less than 3.5 $mg/m^2$ in the presence of a polyanion component (PSS) and a protective polyurethane topcoat undergo at least one order of magnitude increase in electrical resistivity after motion picture print film processing. In addition, the resistivity before processing for the examples is less than $2\times10^9$ Ω/□ which should provide excellent protection from static marking during high speed manufacturing operations and printing, while after film processing the electrical resistivity is between $1\times10^9$ Ω/□ and $1\times10^{11}$ Ω/□ which should provide freedom from static cling and dirt attraction during projection.

Comparative Samples A and B comprise an electrically-conductive layer containing doped tin oxide particles that are well known for use in conductive/antistatic layers for photographic films. Comparative Samples A and B have very low resistivity values before photographic film processing which should provide excellent protection from static marking during high speed operations. However, after photographic film processing the resistivity for these samples actually decreases and these samples are expected to exhibit severe static cling problems during projection.

Comparative Samples C, D, and E comprise an electrically-conductive layer containing vanadium pentoxide that is also well known for use in conductive/antistatic layers for photographic films. Comparative Samples C and D have excellent electrical resistivity values before film processing. However, after film processing Comparative Sample C, which comprises a protective topcoat having an uncrosslinked polyurethane binder, is rendered nonconductive. Such a film would provide poor protection from dirt and dust attraction during projection. For Comparative Sample D, which comprises a protective topcoat having a crosslinked polyurethane binder, the resistivity of the film actually decreases slightly after film processing and this sample is expected to exhibit severe static cling problems during projection. Surprisingly, Examples 1 to 6 of the invention provide essentially the same electrical resistivity performance before and after processing whether a crosslinked or uncrosslinked protective topcoat is employed. Comparative Sample E has a resistivity greater than $2\times10^9$ Ω/□ before processing so that it should provide only moderate protection from static marking. After film processing, the resistivity for Comparative Sample E decreases and this sample is expected to exhibit static cling problems during projection.

Comparative Sample F comprises an electrically-conductive layer containing a polythiophene at a relatively high dry coverage of 3.8 mg/m$^2$ so that the film is highly conductive both before and after processing and the resistivity does not increase by at least one order of magnitude as a result of photographic film processing. This sample, although it should provide excellent protection from static marking before film processing, is expected to exhibit static cling problems after processing and during projection.

Next, various Example films and Comparative Samples described in Table 1 were evaluated in more practical tests to determine their performance with respect to static cling in a projector apparatus that simulates an automated platter system, abrasion resistance in a conventional movie projector, and static marking using the test procedures outlined above. All the films tested provided excellent performance in the projector abrasion test and were given a 1.5 rating. The results for static marking and platter system static cling are summarized in Table 2.

TABLE 2

| Sample | Electrically-Conductive Layer Composition: Conductive agent (mg/m$^2$) | Polymer Binder (mg/m$^2$) | Static Marking | Number of Multiple Lap Pulloffs |
|---|---|---|---|---|
| Example 1* | Baytron P (5.5) (PEDOT (2.1) + PSS (3.4)) | Eastman Chemical AQ29D (44) | None | 0 |
| Example 2** | Baytron P (5.5) (PEDOT (2.1) + PSS (3.4)) | Eastman Chemical AQ29D (44) | None | 0 |
| Example 3* | Baytron P (6.0) (PEDOT (2.3) + PSS (3.7)) | Eastman Chemical AQ29D (48) | None | 0 |
| Example 4** | Baytron P (6.0) (PEDOT (2.3) + PSS (3.7)) | Eastman Chemical AQ29D (48) | None | 0 |
| Example 6** | Baytron P (7.0) (PEDOT (2.7) + PSS (4.3)) | Eastman Chemical AQ29D (56) | None | 0 |
| Comparative Sample D** | Ag-doped vanadium pentoxide (3) | vinylidene chloride copolymer latex (3) | None | 72 |
| Comparative Sample E** | Ag-doped vanadium pentoxide (2) | vinylidene chloride copolymer latex (2) | Static marks on edges and perfs | 3 |
| Comparative Sample F* | Baytron P (10.0) (PEDOT (3.8) + PSS (6.2)) | Eastman Chemical AQ29D (10) | None | 81 |

*topcoat layer contains 0 mg/m$^2$ of CX100 aziridine crosslinker, i.e., polyurethane binder is uncrosslinked.
**topcoat layer contains 6 mg/m$^2$ of CX100 aziridine crosslinker, i.e., polyurethane binder is crosslinked.

The results show only films of the invention which undergo a controlled shift in electrical resistivity as a result of photographic film processing simultaneously provide freedom from static marking and no multiple lap pulloffs in the automated platter system. The Comparative Samples are able to provide either freedom from static marking or little or no multiple pulloffs in the automated platter system, but are unable to simultaneously provide good performance in both tests.

The invention has been described in detail, with particular reference to certain preferred embodiments thereof, but it should be understood that variations and modifications can be effected within the spirit and scope of the invention.

What is claimed is:

1. A multicolor motion picture photographic print film element comprising a support having on one side thereof, in order, a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler, and having, in order, on the opposite side thereof:

an electrically-conductive layer coated from a coating composition comprising a polythiophene/polyanion composition containing a polythiophene with conjugated polymer backbone component and a polymeric polyanion component, and a protective topcoat comprised of a polyurethane binder which has a tensile elongation to break of at least 50% and a Young's modulus measured at 2% elongation of at least 50000 lb/in$^2$;

wherein the electrical resistivity of the electrically-conductive layer before photographic processing is less than $2\times10^9$ Ω/□, after standard ECP-2B photographic processing is between $1\times10^9$ Ω/□ and $1\times10^{11}$ Ω/□, and increases by at least one order of magnitude as a result of standard ECP-2B photographic processing.

2. A photographic element according to claim 1, wherein the polythiophene with conjugated polymer backbone component comprises a 3,4-dialkoxy substituted polythiophene.

3. A photographic element according to claim 1, wherein the polythiophene with conjugated polymer backbone component in the electrically-conductive layer is present at from 0.5 to 3.5 mg/m$^2$.

4. A photographic element according to claim 3, wherein the weight ratio of polythiophene with conjugated polymer backbone component to polymeric polyanion component in the polythiophene/polyanion composition is from 50/50 to 15/85.

5. A photographic element according to claim 4, wherein the electrically-conductive layer further comprises an added non-electrically conductive polymeric binder, and the weight ratio of the polythiophene/polyanion composition to added binder is from 1:1 to 1:20.

6. A photographic element according to claim 5, wherein the weight ratio of the polythiophene/polyanion composition to added binder is from 1:2 to 1:20.

7. A photographic element according to claim 5, wherein the polythiophene with conjugated polymer backbone component contains thiophene nuclei substituted with at least one $C_1$–$C_{12}$ alkoxy group or a —$O(CH_2CH_2O)_nCH_3$ group, with n being 1 to 4.

8. A photographic element according to claim 5, wherein the polythiophene with conjugated polymer backbone component contains thiophene nuclei which are ring closed over two oxygen atoms with a substituted or unsubstituted alklene group.

9. A photographic element according to claim 5, wherein the polythiophene with conjugated polymer backbone component comprises structural units corresponding to the following formula (I)

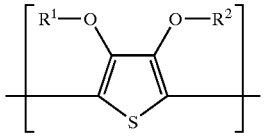

in which: each of $R_1$ and $R^2$ independently represents hydrogen or a $C_{1-4}$ alkyl group or together represent a $C_{1-4}$ alkylene group.

10. A photographic element according to claim 5, wherein the polythiophene with conjugated polymer backbone component comprises a 3,4-dialkoxy substituted polythiophene.

11. A photographic element according to claim 10, wherein the electrical resistivity of the electrically-conductive layer after photographic processing in the standard ECP-2B process is between $2.5\times10^9$ Ω/□ and $1\times10^{11}$ Ω/□.

12. A photographic element according to claim 5, wherein the polythiophene with conjugated polymer backbone component comprises poly(3,4-ethylene dioxythiophene).

13. A photographic element according to claim 12, wherein the polymeric polyanion component is a polymer comprising styrene sulfonic acid units.

14. A photographic element according to claim 13, wherein the protective topcoat comprises Sancure 898™ polyurethane binder which has a tensile elongation to break of 210% and a Young's modulus measured at 2% elongation of 115,000 lb/in$^2$.

15. A photographic element according to claim 5, wherein the polymeric polyanion component is a polymeric carboxylic acid or polymeric sulfonic acid, or such an acid in salt form.

16. A photographic element according to claim 15, wherein the polymeric polyanion component is a polymer comprising styrene sulfonic acid units.

17. A photographic element according to claim 3, wherein the electrical resistivity of the electrically-conductive layer after photographic processing in the standard ECP-2B process is between $2.5\times10^9$ Ω/□ and $1\times10^{11}$ Ω/□.

18. A photographic element according to claim 2, wherein the protective topcoat comprises Sancure 898™ polyurethane binder which has a tensile elongation to break of 210% and a Young's modulus measured at 2% elongation of 115,000 lb/in$^2$.

* * * * *

UNITED STATES PATENT AND TRADEMARK OFFICE

CERTIFICATE OF CORRECTION

PATENT NO. : 6,440,654 B1
DATED : August 27, 2002
INVENTOR(S) : Anderson et al.

It is certified that error appears in the above-identified patent and that said Letters Patent is hereby corrected as shown below:

Column 19,
Line 38, change "alklene" to -- alkylene --

Column 20,
Lines 24 and 39, delete "Sancure 898™"

Signed and Sealed this

Twenty-third Day of November, 2004

JON W. DUDAS
*Director of the United States Patent and Trademark Office*